United States Patent [19]

Takahashi

[11] 4,233,966

[45] Nov. 18, 1980

[54] APPLIANCE FOR USE IN ACUPRESSURE THERAPY

[76] Inventor: George K. Takahashi, 2604 Kelton Ave., Los Angeles, Calif. 90064

[21] Appl. No.: 968,496

[22] Filed: Dec. 11, 1978

[51] Int. Cl.[3] ..... A61H 15/00

[52] U.S. Cl. ..... 128/67; 128/25 B; 128/60

[58] Field of Search ..... 128/68, 69, 60, 24 R, 128/303 R, 67, 25 B

[56] References Cited

U.S. PATENT DOCUMENTS

| | | | |
|---|---|---|---|
| 1,981,379 | 11/1934 | Thomson et al. | 128/69 |
| 2,777,440 | 1/1957 | Baker | 128/69 |
| 2,836,175 | 5/1958 | Nakayama | 128/60 |
| 3,750,654 | 8/1973 | Shiu | 128/57 |

*Primary Examiner*—Robert W. Michell
*Assistant Examiner*—Michael H. Thaler
*Attorney, Agent, or Firm*—Albert M. Herzig; Edward C. Walsh

[57] ABSTRACT

An appliance or aid for use in practicing acupressure or finger pressure therapy. An individual is able to apply finger pressure therapy to himself, to various parts of the anatomy, but of course not to other parts, that is areas of the back, because they cannot be reached. The appliance embodies a holder or platform carrying knobs or protuberances which simulate the fingers for applying the therapeutic pressure. The individual places himself on, that is lays on the appliance, with the appliance positioned so that the simulated fingers apply the therapeutic pressure in the desired areas. A plurality of protuberances or knobs is provided and they are readily removable from the base or platform, the structure for attachment or securement of the protuberances providing for securement in the desired geometrical patterns configurated to be appropriate to apply the therapy to particularized areas established in accordance with knowledge of finger pressure therapy. The user can readily form desired geometrical patterns of protuberances and to then cause the appropriate part of his anatomy to have pressure applied thereto.

1 Claim, 7 Drawing Figures

APPLIANCE FOR USE IN ACUPRESSURE THERAPY

BACKGROUND OF THE INVENTION

1. Field of the Invention

The field of the invention is in the area of acupressure or finger pressure therapy, which is dealt with more in detail hereinafter. More particularly, the field is that of therapeutic aids on appliances, more especially, a unique appliance is adapted and designed to enable a user to apply finger pressure therapy to parts of the anatomy which can not be reached by the natural fingers.

2. Description of the Prior Art

Acupressure or finger pressure therapy is a method of therapy utilizing digital compression, that is applying pressure with the fingers, more particularly the thumb and forefinger to areas of the anatomy. The Japanese word for the therapy is Shiatsu and the nature and purpose of the therapy is fully described in the volume entitled JAPANESE FINGER PRESSURE THERAPY-SHIATSU, published by Japan Publications, Inc. and distributed by Japan Publications Trading Company, 1255 Howard Street, San Francisco, Calif. 94103; P.O. Box 5030 Tokyo International, Tokyo, Japan.

The therapy, can of course be applied by a person to any part of the anatomy of a patient, that is another person. The therapy is designed to aid in the relief of common aches and pains affecting the back and associated with long hours of standing, sitting and bending. The concept is different than that of massage which depends on the rubbing or kneading of tense muscles for relaxation thus stimulating the blood circulation to relieve pain. An individual can apply the therapy to himself, but of course there are parts of the anatomy that an individual can not reach. To the knowledge of the herein inventor, no means, or appliance, or aid has been available to enable an individual to apply the therapy to certain parts of his own anatomy that is his back. There is a need for such a means or appliance which has not previously been met in the prior art to the knowledge of the herein inventor.

The inventor as described herein in detail, provides a means and a particular appliance having the capability of fulfilling the need as identified in the foregoing.

SUMMARY OF THE INVENTION

The nature of the invention is briefly described in the abstract.

Presently, available knowledge, with respect to the art or therapy of acupressure identifies various basic pressure points in the human anatomy, the points being identifiable on charts or diagrams of the front and back of the human anatomy. The desired points of application of pressure may be at or near specific areas of complaint or on the other hand, pressure applied to remote areas may bring about the greatest relief. This type of knowledge and skill is of course already known in the field of finger pressure therapy. For purposes of adapting the therapy to enable an individual to apply to himself or herself therapy to areas that can not be reached, the herein invention provides an appliance which fills this need.

The preferred exemplary form of the invention as described in detail herein, takes the form of a base or platform member which carries a plurality of knobs or protuberances which simulate the fingers for purposes of applying the therapy. The knobs or protuberances are removable from the base and means are provided to secure them to the base in desired geometrical therapeutical patterns so as to apply pressure in that pattern to the particular pattern of points needing pressure. In the preferred form, the knobs are made generally spherical or globular with extending stems which fit into a pattern of holes in the base member. In this manner, a desired therapeutical geometrical pattern of simulated fingers can readily be established. Preferably there may be six knobs or protuberances.

In utilizing the appliance, the user simply places his body in position and lays on it with the appliance underneath the particular area to be treated. Thus, the individual can move from one position to another over the appliance to cause the treatment to be applied as desired and of course the user can move if desired to produce relative movement between the particular area of his anatomy and the appliance.

The appliance is designed to relieve pain in the neck, shoulders, along the spine and the lower back, utilizing the principles as explained. The relief from backache in pressure therapy by laying against the knobs or protuberances is analogous to obtaining relief by having someone sit or walk on one's back. The relief is obtained by stretching the muscles through pressure, thus relieving tightness along the spinal column.

In the light of the foregoing, the primary object of the invention is to provide a therapeutic appliance, particularly constructed to make it possible for an individual to apply the finger pressure therapy to parts of his body that he can not reach himself.

A further object is to provide an appliance as in the foregoing, in the form of a base or holder member carrying protuberances to simulate fingers which are attachable to the base in a variety of geometrical therapeutical arrangements or patterns.

A further object is to make available an appliance as in the foregoing, wherein the protuberances are in the form of globular knobs having stems, the base having patterns of holes to receive the stems.

Further objects and additional advantages of the invention will become apparent from the following detailed description and annexed drawings.

DESCRIPTION OF THE PREFERRED EMBODIMENT AND BEST MODE OF PRACTICE

Figure 1:
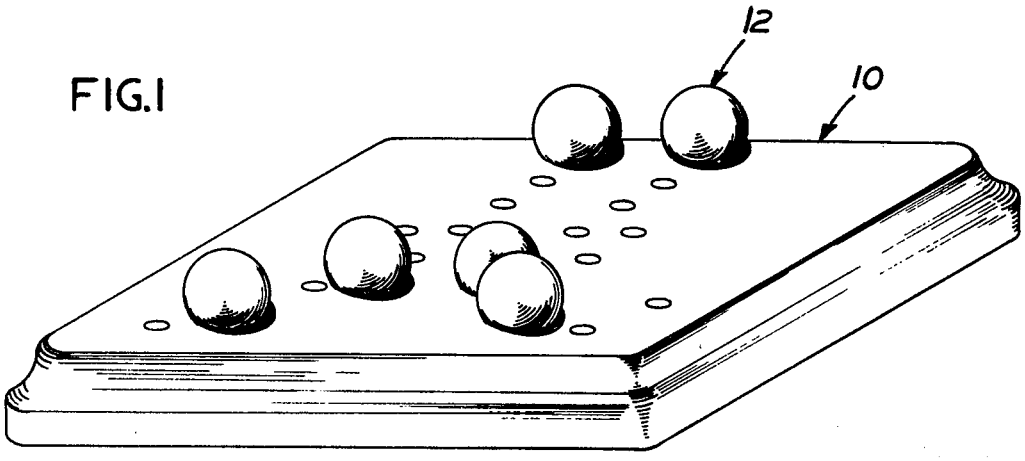
FIG. 1 is a pictorial view of a preferred form of the invention.
Figure 2:
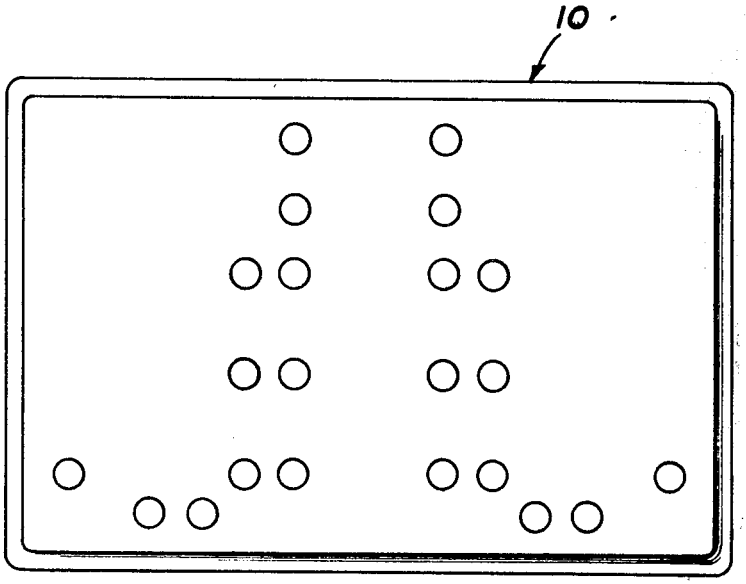
FIG. 2 is a plan view of the base member showing a pattern of holes to receive the protuberances.
Figure 3:
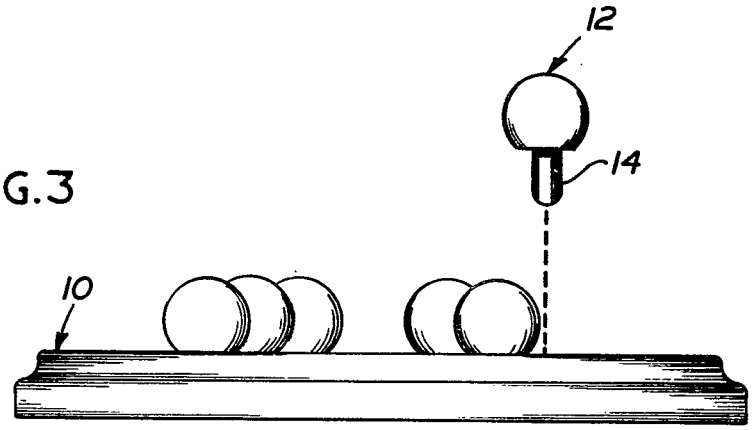
FIG. 3 is an elevational view of the form of the invention shown in FIGS. 1 and 2.

Referring to FIGS. 1, 2 and 3 of the drawings, numeral 10 designates a base member which in the form shown is rectangular and which may be made of any suitable material, such as wood, plastic, or otherwise. The member 10 is thick enough so that it can receive the stems of simulated finger members as will be described. Provided in the surface of the member 10 is a pattern of holes of relatively small size as may be seen in FIGS. 1 and 2 which illustrate a particular pattern of holes. The holes may be in different patterns or if desired, there may be a uniform grid of holes.

In the form of the invention shown, the simulated finger members are generally spherical or globular in form as designated at 12. Each has an extending stem as designated at 14 which may be inserted into one of the holes in the surface of the member 10. Thus, a desired number such as from two or more of the simulated pressure members may be applied to the base member 10 in a desired geometrical therapeutical pattern as will be described hereinafter.

Figure 4:
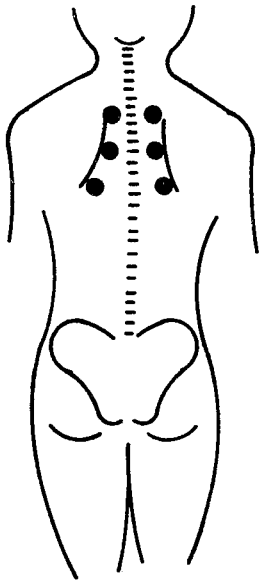
FIGS. 4–7 are diagrametic views of the rear of the individual anatomy, illustrating exemplary patterns of areas to which therapeutic pressure may be applied by the appliance of the invention.

FIGS. 4–7 are representative charts or diagrams of the back of the human anatomy illustrating exemplary geometrical therapeutical patterns in particularlized areas to which finger pressure may be applied in practising the method of treatment. FIG. 4, for example, shows a pattern of 6 points adjacent to the thoracic vertebrae middle shoulder to which pressure would be applied as affective therapy for palpitation, stiff shoulders and the like.

Figure 5:
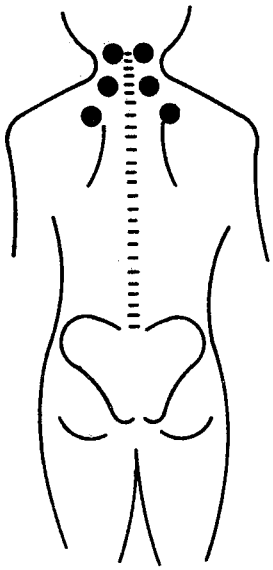

FIG. 5 shows a pattern of six pressure points to the lower back of the head, upper neck and shoulders to which pressure would be applied as therapy for complaints involving these areas.

Figure 6:
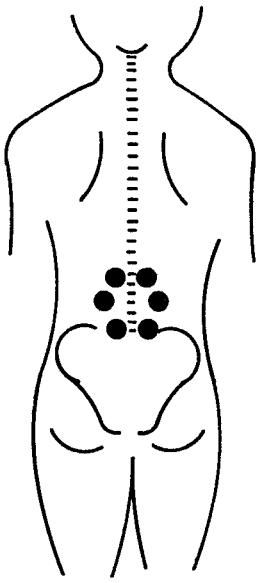

FIG. 6 shows a pattern adapted for similar treatment with a different geometrical shape, for arrangement of the pressure points.

Figure 7:
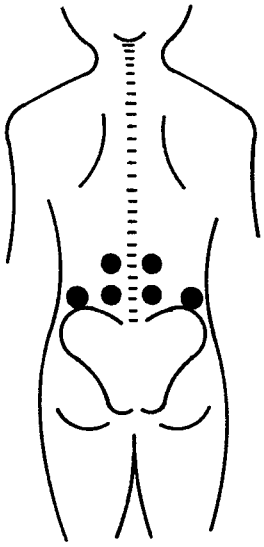

FIG. 7 shows an arrangement of pressure points in a different pattern, utilizable in the lower back area.

In utilizing the invention, the user, of course will have a knowledge of the art or science of acupressure or finger pressure therapy. The user will decide upon areas of the anatomy to which the therapy is to be applied and will then establish a pattern of protuberances or simulated fingers by appropriately arranging members 12 with respect to the base member 10, by inserting the stems 14 into the holes in the base member. The appliance may then of course be simply placed on the floor or on a bed and the user lays on it with the proper area of his back over the pre-arranged pattern of simulated finger members. The user can then move or manipulate his body to regulate pressure being applied by the protuberances or knobs 12, as if they were fingers. In this manner, the user is able to practice the therapy himself on areas of the anatomy that he can not reach with his natural fingers.

As will be apparent from the drawings, the openings in which the pressure member 12 are placed are arranged in two groups, each group being of generally J-shape and arranged on the base 10 with the hook portions of the letter "J" extending away from each other and with the stems of the letter "J" being generally parallel.

From the foregoing, those skilled in the art will readily understand the nature of the invention and the manner of its utilization in the practice of finger pressure therapy. The device is very simple, but effective for its purpose and can be very readily fabricated, assembled and used.

The foregoing disclosure is representative of a preferred form of the invention and is to be interpreted in an illustrative rather than a limiting sense, the invention to be accorded the full scope of the claims annexed hereto.

What is claimed is:

1. An appliance for use in practicing finger pressure therapy, in combination, a first rigid substantially planar member adapted for positioning in proximity to a portion of the human body, a plurality of substantially spherical knob members, said members having stem portions adapting them for fixed securement to said first member, said first member having a pair of groups of openings for receiving said stem portions, said groups being arranged symmetrically on said first member and the openings of one group comprising a generally J-shaped array of openings arranged in mirror-image relation to the openings of the other group with the hook portion of each array extending away from each other and the stems of the arrays being generally parallel.

* * * * *